US005520998A

United States Patent [19]

Uemoto et al.

[11] Patent Number: 5,520,998

[45] Date of Patent: May 28, 1996

[54] HIGHLY WATER-PRESSURE-RESISTANT AND HIGHLY MOISTURE-PERMEABLE WATERPROOF SHEET AND METHOD FOR PRODUCING SAME

[75] Inventors: Masanori Uemoto, Uji; Takenori Huruya, Kyoto; Takahiro Sekimoto, Sendai; Hisao Kondo, Niigata; Kouichi Nishizakura, Ohtsu; Toshiaki Nakano, Joyo, all of Japan

[73] Assignee: Toray Industries, Inc., Tokyo, Japan

[21] Appl. No.: 244,779

[22] PCT Filed: Oct. 7, 1993

[86] PCT No.: PCT/JP93/01448

§ 371 Date: Jul. 8, 1994

§ 102(e) Date: Jul. 8, 1994

[87] PCT Pub. No.: WO94/08785

PCT Pub. Date: Apr. 28, 1994

[30] Foreign Application Priority Data

Oct. 12, 1992 [JP] Japan ..... 4-300343

[51] Int. Cl.[6] ..... B05D 3/00; B32B 5/12; B32B 27/12; B32B 27/18

[52] U.S. Cl. ..... 428/241; 427/246; 427/354; 427/412; 428/253; 428/262; 428/283; 428/315.5; 428/315.9; 428/421

[58] Field of Search ..... 427/246, 354, 427/412; 428/241, 262, 315.5, 315.9, 421, 253, 283

[56] References Cited

U.S. PATENT DOCUMENTS 5,204,403 4/1993 Furuta et al. .

FOREIGN PATENT DOCUMENTS

| | | |
|---|---|---|
| 1957889 | 6/1971 | Germany . |
| 000382 | 1/1981 | Japan . |
| 60-162872 | 8/1985 | Japan . |
| 2-169772 | 6/1990 | Japan . |
| 2-281942 | 11/1990 | Japan . |
| 4-202857 | 7/1992 | Japan . |
| 194082 | 7/1992 | Japan . |
| 9305929 | 6/1993 | Rep. of Korea . |

*Primary Examiner*—James C. Cannon
*Attorney, Agent, or Firm*—Fish & Richardson

[57] ABSTRACT

The present invention provides a highly water-pressure-resistant and highly moisture-permeable waterproof sheet comprising a fabric and a wet coagulated polyurethane film thereon, a organophilic clay complex prepared by introducing a quaternary ammonium ion into the interlayers of a expandable phillosilicate being dispersed into the wet coagulated polyurethane film in an amount of 0.5 to 20% by weight based on the solid component of the polyurethane, and the waterproof sheet having a water pressure resistance of at least 5,000 mm and a moisture permeability of at least 8,000 g/m$^2$.24 hr. The waterproof sheet is prepared by a process comprising dissolving a polyurethane in a solvent containing mainly a nitrogen-containing polar solvent, dispersing a organophilic clay complex which is prepared by introducing a quaternary ammonium ion into the interlayers of a expandable phillosilicate into the polyurethane-containing solution in an amount of 0.5 to 20% by weight based on the solid component of the polyurethane, coating a fabric with the resultant solution, immersing the coated fabric in a coagulation bath whereby the polyurethane is coagulated, washing the resultant fabric with water, and drying it.

13 Claims, 2 Drawing Sheets

HIGHLY WATER-PRESSURE-RESISTANT AND HIGHLY MOISTURE-PERMEABLE WATERPROOF SHEET AND METHOD FOR PRODUCING SAME

TECHNICAL FIELD

The present invention relates to a waterproof sheet having both a high water pressure resistance and a high moisture permeability and a method for producing the same.

BACKGROUND ART

A conventional moisture-permeable waterproof sheet is mainly produced by coating a fabric with a solution of polyurethane in a water-soluble solvent, and wet coagulating the polyurethane. Rain or other types of water cannot permeate the porous polyurethane film formed thereon when the solvent is removed with water, but moisture (water vapor) can permeate it.

However, when the porosity of the waterproof fabric is increased (the number of pores are increased and the pore size becomes large) to improve the permeability, the water pressure resistance thereof does not fail to fall, and the waterproof sheet is not waterproof. Conversely, when the water pressure resistance thereof is improved (the number of pores is decreased and the pore size becomes small), the moisture permeability thereof is lowered. Accordingly, the improvement of the moisture permeability conflicts with that of the water pressure resistance.

DISCLOSURE OF INVENTION

An object of the present invention is to overcome the contradiction described above, and develop a waterproof sheet having both a high water pressure resistance and a high moisture permeability. The present invention is intended to provide a novel waterproof fabric having both a water-pressure resistance as high as at least 5,000 mm and a moisture permeability as high as at least 8,000 g/m$^2$.24 hr.

The present invention provides a highly water-pressure-resistant and highly moisture-permeable waterproof sheet comprising a fabric and a wet coagulated polyurethane film thereon, said wet coagulated polyurethane film containing from 0.5 to 20% by weight, based on the solid component of the polyurethane, of a dispersed clay organic composite prepared by introducing a quaternary ammonium ion into the interlayers of a expandable phillosilicate, and said waterproof sheet having a water pressure resistance of at least 5,000 mm and a moisture permeability of at least 8,000 g/m$^2$.24 hr.

The waterproof sheet of the present invention mentioned above is prepared by a process comprising dissolving a polyurethane into a solvent containing mainly a nitrogen-containing polar solvent, dispersing from 0.5 to 20% by weight, based on the solid component of the polyurethane, of a organophilic clay complex prepared by introducing a quaternary ammonium ion into the interlayers of a expandable phillosilicate in the solution, coating a fabric with the resultant solution, immersing the coated fabric in a coagulation bath whereby the polyurethane is coagulated, washing the resultant fabric, and drying it.

BEST MODE FOR CARRYING OUT THE INVENTION

Figure 1:
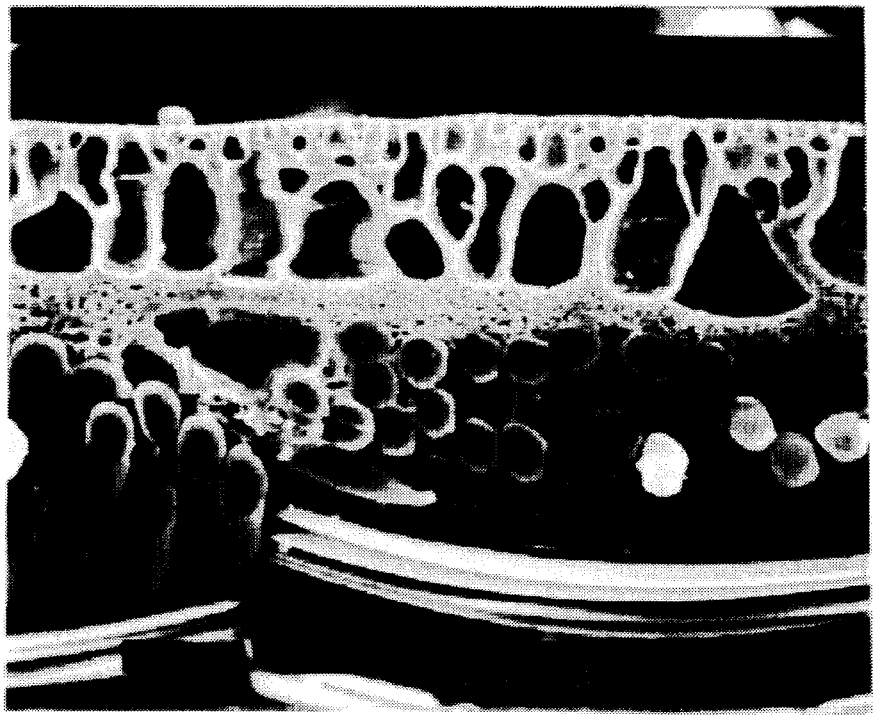
FIG. 1 is a SEM photograph of a cross section of a waterproof sheet obtained in an example of the present invention.

The highly water-pressure-resistant and highly moisture-permeable sheet of the present invention will be explained in detail in accordance with the steps of the production thereof.

Polyurethanes used in the present invention include conventional polyester polyurethanes, polyether polyurethanes, polycarbonate polyurethanes, or modified polyurethanes prepared by copolymerizing with a polyamino acid, silicone, fluoromonomer, etc., or polyurethane elastomers obtained by optionally blending these polyurethanes. Such a polymer is dissolved in a water-soluble solvent mainly containing a nitrogen-containing polar solvent in an amount of 15 to 30% by weight, and the resultant solution is used as a solution of polyurethane in a nitrogen-containing polar solvent. In addition, a solution of a polyurethane obtained by solution polymerization may naturally be used after adjusting the concentration thereof without further processing.

Dimethylformamide (DMF) is preferred as the nitrogen-containing polar solvent. There may also be employed a solvent mixture obtained by mixing DMF with N-methylpyrrolidone, methyl ethyl ketone or the like solvent.

A expandable phillosilicate in the present invention is a phillosilicate having a triple-layer structure wherein a magnesium or aluminum octahedral layer is sandwiched between two silica tetrahedral layers. The swelling lamellar silicate has a cation-exchanging ability, and further exhibits the peculiar properties of incorporating water into the interlayers and swelling. Smectite clay, swelling mica, and the like are known as swelling lamellar silicates.

Examples of the smectite clay are natural or synthetic smectite clays such as hectorite (such as LUCENTITE (trade name) manufactured by CO-OP Chemical Co., Ltd.), saponite, stevensite, beidellite, montmorillonite, nontronite and bentonite, or substituents, derivatives or a mixture of these substances.

Examples of the swelling mica are chemically synthesized swelling mica such as SOMASIF (trade name, manufactured by CO-OP Chemical Co., Ltd.) and tetrasilicic mica containing a Li ion or Na ion in the interlayers, taeniolite, or substituents, derivatives or a mixture of these substances.

The organophilic clay complex used in the present invention can be obtained by ion exchanging an interchangeable cation of a expandable phillosilicate for a quaternary ammonium ion.

There is no specific limitation on the method for producing the organophilic clay complex so long as the interchangeable cation of the clay can be efficiently ion exchanged for a quaternary ammonium ion. One example of the method comprises adding to a dispersion containing from 1 to 5% by weight of a expandable phillosilicate in water, a solution of a quaternary ammonium salt in an amount 0.5 to 1.5 times (as equivalents) as much as that of the expandable phillosilicate in terms of cation exchange capacity.

There is no specific limitation on the useful quaternary ammonium ion so long as it has a group which imparts swelling dispersibility to a nitrogen-containing polar solvent. For example, there can be mentioned as an appropriate example a quaternary ammonium ion of the general formula

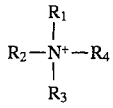

wherein $R_1$ is an alkyl group of 1 to 22 carbon atoms or a benzyl group, $R_2$ is an alkyl group of 1 to 22 carbon atoms or a $(C_mH_{2m}O)_nH$ group (wherein m is an integer of 2 to 6, and n is an integer of 1 to 50), and $R_3$ and $R_4$ are each independently an alkyl group of 4 to 22 carbon atoms or a $(C_mH_{2m}O)_nH$ group (wherein m is an integer of 2 to 6, and n is an integer of 1 to 50). R1 herein is preferably a methyl group, and $R_2$, $R_3$ and $R_4$ are each preferably an alkyl group of 1 to 18 carbon atoms.

The organophilic clay complex used in the present invention preferably has properties as described below. It is swollen in a nitrogen-containing polar solvent and is easily dispersed thereinto, whereby most of the dispersed particles become flaky ultrafine particles having a thickness of 0.001 to 0.04 μm.

When the particle shape of a expandable phillosilicate is not appropriate and such ultrafine particles, which have a very small thickness, of a organophilic clay complex are difficult to obtain, or when fine particles thereof having a smaller particle size in the plane direction are desired, the expandable phillosilicate is subjected to inorganic particle pulverizing treatment, high speed shear cleavage of a wet type or a dry type, or ultrasonic cleavage, prior to forming the organophilic clay complex. The organophilic clay complex prepared from the resultant expandable phillosilicate can be dispersed into a nitrogen-containing polar solvent to form flaky fine particles having a thickness of 0.001 to 0.04 μm at the time of dispersion.

In the preparation of the waterproof sheet of the present invention, the organophilic clay complex is dispersed into the solution of a polyurethane in a nitrogen-containing polar solvent as mentioned above in an amount of 0.5 to 20% by weight, preferably 1 to 8% by weight based on the solid component of the polyurethane, and the resultant solution is used.

When the amount of the organophilic clay complex dispersed is less than 0.5% by weight based on the polyurethane solid component, the number of pores in the polyurethane film becomes insufficient due to the insufficient amount of the organophilic clay complex which is to become the nuclei of coagulation. As a result, the moisture permeability is lowered, and the object of the present invention cannot be achieved. On the other hand, when the dispersed amount exceeds 20% by weight based the polyurethane solid component, the number of pores is unnecessarily increased due to the excessive number of nuclei of coagulation. The pore size thereof then becomes large due to the mutual interconnection of the pores, and there arises a disadvantage that the water pressure resistance does not reach the high level that the present invention aims at.

A fabric is then coated with the polyurethane-containing solution prepared by dispersing the organophilic clay complex in a suitable range in a manner as described above. Other assistants such as a fluorine type repellent and a crosslinking agent may of course be added to the solution at the time of coating.

Moreover, as the fabric, there may be used plain weave fabrics (taffeta, etc.), twill fabrics or knits of various synthetic fibers, or there may also be used various types of fabrics and knits of natural fibers or semi-synthetic fibers, or unwoven cloth, and the like.

In addition, it is desirable that these fabrics should be treated with a water repellent in advance for the purpose of preventing permeation.

The coating amount of the polyurethane-containing solution is preferably from 50 to 500 g/m$^2$ in a wet state. When the amount is less than 50 g/m$^2$, the polyurethane porous film becomes unduly thin, and the fabric cannot exhibit a high water-pressure resistance. On the other hand, when the coating amount exceeds 500 g/m$^2$, the improvement of the effect exceeding a predetermined expectation cannot be achieved, and an adverse effect tends to be exerted on the moisture permeability.

In addition, the fabric may be coated by any of various methods such as knife coating, knife-over-roll coating and reverse roll coating.

The coated fabric is then immersed in a coagulation solution containing mainly water whereby the nitrogen-containing polar solvent is eluted in water and removed and the polyurethane is coagulated.

Since the above-mentioned organophilic clay complex is dispersed as flaky ultrafine particles having a thickness of 0.001 to 0.04 μm during coagulation, the ultrafine particles act as nuclei of coagulation (gelation), and as a result the individual pores become extremely fine. Accordingly, coagulated cells each having a pore size of about 0.1 to 1.0 μm are formed near the base fabric boundary face, and porous layers of ultrafine cells are formed in a highly aggregated state in addition to relatively large fine pores specific to the polyurethane film obtained by wet coagulation.

In addition, though the coagulation bath may be composed of only water, a nitrogen-containing polar solvent may also be dissolved therein in advance in an amount of up to 40% by weight for the purpose of controlling the coagulation rate. The fabric is then washed with water after the completion of coagulation by immersion in water, and dried to obtain the waterproof sheet of the present invention.

The waterproof sheet of the present invention is one obtained by the production steps as described above, and has both a high water pressure resistance, of at least 5,000 mm, and a high moisture permeability of at least 8000 g/m$^2$. 24 hr.

The waterproof sheet of the present invention has such a high moisture permeability because pores having a size as fine as from 0.1 to 1.0 μm (the fine pores with the size being said not to allow water particles to permeate the polyurethane film and allow water vapor to permeate it) are formed in layers near the base fabric boundary face in a highly aggregated state.

The formation of the ultrafine pores in a highly aggregated state is achieved by appropriately incorporating the organophilic clay complex into the solution of a polyurethane in a nitrogen-containing polar solvent. In other words, the organophilic clay complex acts as nuclei of wet coagulation of the polyurethane. As a result, the formation of large pores near the boundary face of the base fabric is retarded, and only ultrafine pores are formed aggregatedly. Moreover, the waterproof sheet exhibits an improved peeling strength because of the presence of such layers.

In addition, the reason why the organophilic clay complex used in the present invention brings about excellent results compared with other inorganic fine particles and organic fine particles have not been definitely elucidated. However, the reason is presumably as described below. Since the organophilic clay complex used in the present invention is a lamellar ultrafine particles, the orienting tendency of the organophilic clay complex presumably acts on the particles, and the particles tend to be arranged in a certain direction and aggregated. As a result, ultrafine pores tend to form in a highly aggregated state.

Furthermore, since the organophilic clay complex is dispersed in the polyurethane film of the waterproof sheet of the present invention, the size of the fine pores open to the surface thereof is as small as from 0.05 to 2 μm though the reason is not definite. The size is far smaller than the size (0.5 to 3 μm) of fine pores open to the surface of a conventional polyurethane film. Accordingly, the waterproof sheet of the invention exhibits a high hydraulic pressure resistance of 5,000 mm, a very high value which has never before been obtained.

The present invention will be further illustrated by making reference to examples.

Examples 1 to 8 and Comparative Examples 1 and 2

A nylon taffeta prepared from nylon filament yarn of 70 denier was treated with a fluorine type water repellent as described below.

The taffeta was immersed in an aqueous dispersion containing 3% by weight of a water repellent, squeezed at a pick-up of 40%, and dried and heat treated at 150° C. for 30 sec.

The water-repellant nylon taffeta thus obtained was coated with either one of solutions of 10 types (Examples 1 to 8, Comparative Examples 1 and 2) of recipes as listed in Table 1 in an amount of 150 g/m$^2$, and immersed in a bath of a coagulation solution which was an aqueous solution containing 10% by weight of DMF at 30° C. for 3 minutes whereby the coating solution containing a polyurethane was wet coagulated. The coated nylon taffeta was then washed with hot water at 80° C. for 10 minutes, and hot-air dried at 140° C., followed by heat treating at 160° C. for 3 minutes. Ten types of waterproof sheets were thus prepared on an experimental basis.

Substances listed in Table 1 are concretely described below.

Polyurethane elastomer

Crisvon 8166 (trade name, manufactured by Dainippon Ink and Chemicals Incorporated)

Fluorine type water repellent

Asahi Guard AG 650 (trade name, manufactured by Meisei Chemical Co., Ltd.)

Crosslinking agent

Burnock D 500 (trade name of a block isocyanate manufactured by Dainippon Ink and Chemicals Incorporated)

Organophilic clay complex A

Lucentite STN (trade name, manufactured by CO-OP Chemical Co., Ltd.)

Organophilic clay complex B

Lucentite SWN (trade name, manufactured by CO-OP Chemical Co., Ltd.) was dispersed into water, and a quaternary ammonium salt of the formula

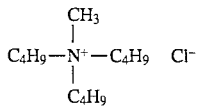

was added to the dispersion in an amount 1.5 times as much as that of Lucentite SWN, in terms of exchange capacity, to effect reaction. The resultant mixture was filtered, and the residue was washed and dried to obtain the organophilic clay complex B.

Organophilic clay complex C

Synthetic swelling mica (trade name: Somasif ME, manufactured by CO-OP Chemical Co., Ltd.) prepared by heat treating talc and sodium silicofluoride at 850° C. was pulverized by Ultraviscomill (trade name of a grinding mill manufactured by Aimex Co., Ltd.), and ultrasonically treated in water at 27 kHz for 3 hours. The ultrasonically treated substance was dispersed into water, and a quaternary ammonium salt of the formula

TABLE I (Recipe: parts by weight)

| | | Comp. Ex. | | Example | | | | | | | |
|---|---|---|---|---|---|---|---|---|---|---|---|
| | | 1 | 2 | 1 | 2 | 3 | 4 | 5 | 6 | 7 | 8 |
| *Polyurethane elastomer: | | 25 | 25 | 25 | 25 | 25 | 25 | 25 | 25 | 25 | 25 |
| **F-type repellent | | 5 | 5 | 5 | 5 | 5 | 5 | 5 | 5 | 5 | 5 |
| Crosslinking agent | | 1 | 1 | 1 | 1 | 1 | 1 | 1 | 1 | 1 | 1 |
| Orgamo-philic clay complex | Type | — | — | A | A | A | B | C | D | E | F |
| | Amt. | — | — | 0.25 | 1 | 2 | 1 | 1 | 1 | 1 | 1 |
| Porous silica gel | | — | 1 | — | — | — | — | — | — | — | — |
| Dimethyl-formamide | | 100 | 100 | 100 | 100 | 100 | 100 | 100 | 100 | 100 | 100 |

Note:
*Solid component
**F-type = Fluorine type

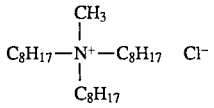

was added to the dispersion in an amount 1.5 times as much as that of the synthetic swelling mica in terms of exchange capacity to effect reaction. The resultant mixture was washed, and dried to obtain the organophilic clay complex C.

Organophilic clay complex D

Lucentite SWN (trade name, manufactured by CO-OP Chemical Co., Ltd.) was dispersed into water, and a quaternary ammonium salt of the formula

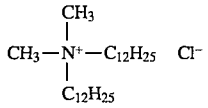

was added to the dispersion in an amount 1.5 times as much as that of Lucentite SWN in terms of exchange capacity to effect reaction. The resultant mixture was filtered, and the precipitation was washed and dried to obtain the organophilic clay complex D.

Organophilic clay complex E

Lucentite SWN (trade name, manufactured by CO-OP Chemical Co., Ltd.) was dispersed into water, and a quaternary ammonium salt of the formula

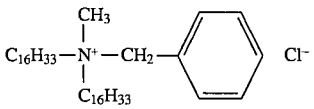

was added to the dispersion in an amount 1.5 times as much as that of Lucentite SWN in terms of exchange capacity to effect reaction. The resultant mixture was filtered, and the residue was washed and dried to obtain the organophilic clay complex E.

Organophilic clay complex F

Lucentite SWN (trade name, manufactured by CO-OP Chemical Co., Ltd.) was dispersed into water, and a quaternary ammonium salt of the formula

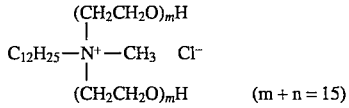

was added to the dispersion in an amount 1.5 times as much as that of Lucentite SWN in terms of exchange capacity to effect reaction. The resultant mixture was filtered, and the residue was washed and dried to obtain the organophilic clay complex F.

Porous silica gel

Syloid 244 (trade name, manufactured by Fuji Devison Chemical Co., Ltd.) having a particle size of 1 to 4 μm was used.

In addition, in Comparative Example in Table 1, fine particles were not mixed and dispersed, and in Comparative Example 2, the porous silica gel having a particle size of 1 to 4 μm was used as fine particles.

Examples 1 to 8 are the examples of the present invention, and the types and amounts of the organophilic clay complexs were changed therein.

Measurements were made on the ten types of waterproof sheets thus obtained, and the physical data thus obtained are shown in Table 2.

TABLE 2

(Physical Data)

| | Comp. Ex. | | Example | | | | | | | |
|---|---|---|---|---|---|---|---|---|---|---|
| | 1 | 2 | 1 | 2 | 3 | 4 | 5 | 6 | 7 | 8 |
| Water pressure resistance mm | 5000 | 2500 | 10000 | 8000 | 5500 | 6800 | 7500 | 7100 | 7200 | 5800 |
| Moisture permeability $g/m^2 \cdot 24$ hr | 3000 | 5000 | 8500 | 10000 | 12000 | 9000 | 9600 | 9100 | 87000 | 8500 |
| Peeling Strength g/cm | 180 | 270 | 350 | 450 | 400 | 390 | 430 | 400 | 410 | 380 |

Methods for measuring each of the data in Table 2 are as described below.

The water pressure resistance is measured in accordance with JIS L 1092.

The moisture permeability is measured in accordance with JIS L 1099 (A-1), (B-1).

The peeling strength is measured by applying a hot-melt adhesive tape having a width of 1 cm to a polyurethane film on the fabric, peeling the end portion of the film, and pulling the tape by a tensile machine. The peeling strength is expressed by the amount of continuously peeled film in terms of gram.

It is seen from Table 2 that the waterproof sheet in Comparative Example 1 prepared without gelation nuclei exhibits a low moisture permeability though the water pressure resistance is high, and that the waterproof sheet in Comparative Example 2 prepared with ordinary fine particles exhibits a poor water pressure resistance though the moisture permeability is improved.

On the other hand, the waterproof sheets in Examples of the present invention all exhibit both a high water pressure resistance and a high moisture permeability, and their peeling strengths are all greatly improved compared with those of the waterproof sheets in Comparative Examples. Moreover, it can be concluded from the detailed investigation of Examples of the present invention that the moisture permeability the present invention aims at can be achieved by the use of the organophilic clay complex in an amount of at least 1% by weight based on the polyurethane solid component, and that the water pressure resistance the present invention aims at can be achieved by the use thereof in an amount of up to 8% by weight.

Furthermore, it has become evident from similar experiments which are not shown in the table that the waterproof sheets exhibit an unduly low moisture permeability when the organophilic clay complex is used in an amount of less than 0.5% by weight based on the polyurethane solid component and an unduly low water pressure resistance when the composite is used in an amount of at least 20% by weight.

Figure 2:
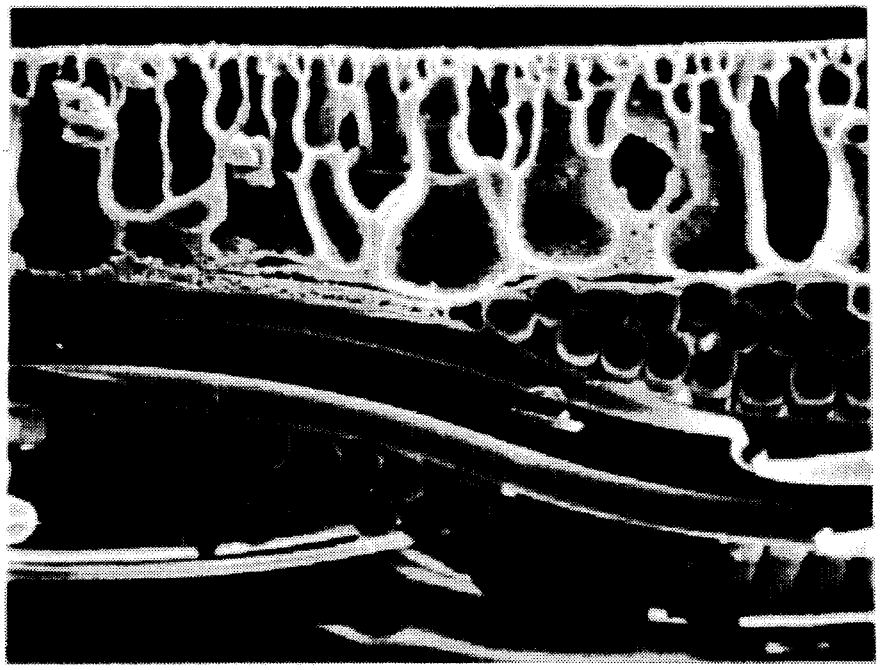
FIG. 2 is a SEM photograph of a cross section of a waterproof sheet in a comparative example of the present invention.
Figure 3:
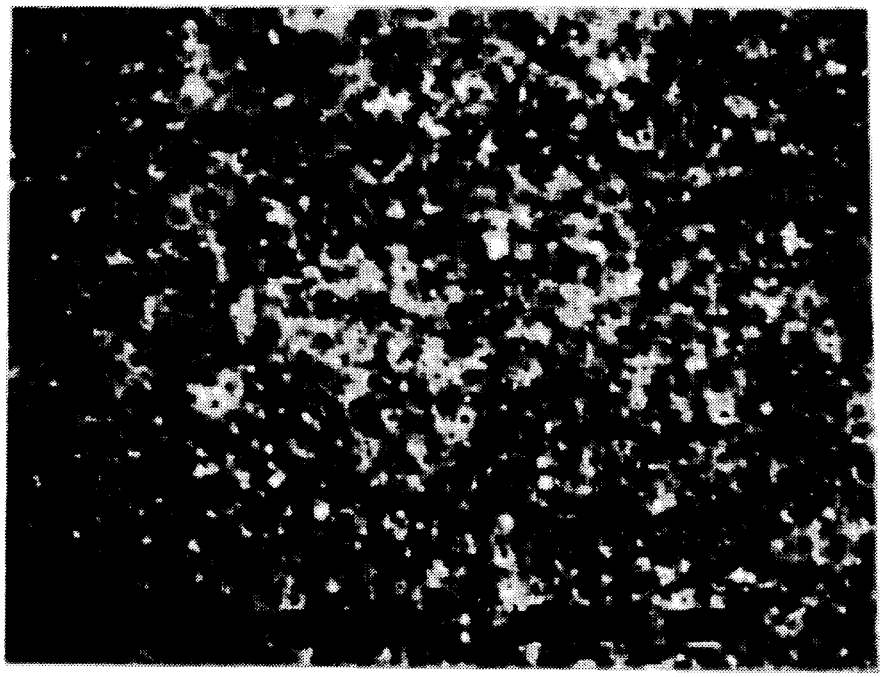
FIG. 3 is a SEM photograph of the polyurethane film surface of a waterproof sheet obtained in an example of the present invention.
Figure 4:
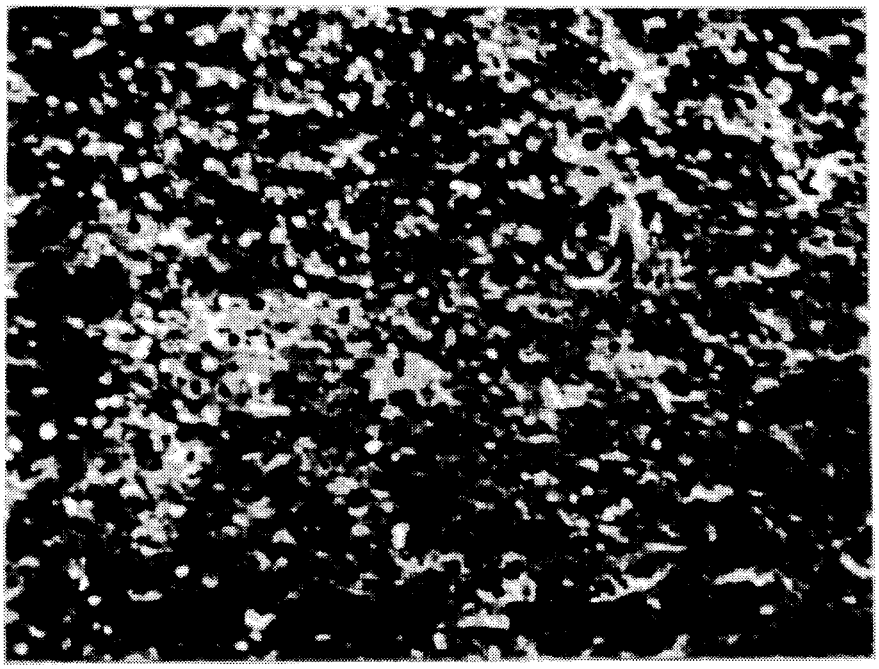
FIG. 4 is a SEM photograph of the polyurethane film surface of a waterproof sheet obtained in a comparative example of the present invention.

The SEM photographs of the cross section and the polyurethane film surface of the waterproof sheet obtained in Example 2 are shown in FIG. 1 and FIG. 3, respectively. The SEM photographs of the cross section and the polyurethane film surface of the waterproof sheet obtained in Comparative Example 1 are shown in FIG. 2 and FIG. 4, respectively. It is seen that fine pores are concentratedly formed near the boundary face between the fabric and the wet coagulated polyurethane film of the waterproof sheet obtained in Example 2.

Industrial Applicability

The present invention provides a waterproof sheet having both a high water-pressure resistance, of at least 5,000 mm, and a high moisture permeability of at least 8000 g/m$^2$.24 hr. There has never been such a waterproof sheet which has exhibits two mutually conflicting physical properties to such a high degree. The waterproof sheet is an excellent and useful one and is a very comfortable clothing material which rain and seawater cannot penetrate and which does not become stuffy.

We claim:

1. A highly water-pressure-resistant and highly moisture-permeable waterproof sheet comprising a fabric and a wet coagulated polyurethane film thereon, said wet coagulated polyurethane film containing from 0.5 to 20% by weight, based on the solid component of the polyurethane, of a dispersed organophilic clay complex prepared by introducing a quaternary ammonium ion into the interlayers of a expandable phillosilicate, and said waterproof sheet having a water pressure resistance of at least 5,000 mm and a moisture permeability of at least 8000 g/m$^2$.24 hr.

2. The waterproof sheet according to claim 1 wherein said expandable phillosilicate is at least one substance selected from the group consisting of smectite clay and swelling mica.

3. The waterproof sheet according to claim 2 wherein said expandable phillosilicate is smectite clay.

4. The waterproof sheet according to claim 1 wherein said organophilic clay complex is in flaky fine particles each having a thickness of 0.001 to 0.04 μm.

5. The waterproof sheet according to claim 1, 2, 3 or 4 wherein said quaternary ammonium ion is represented by the following general formula

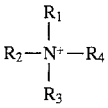

wherein $R_1$ is an alkyl group of 1 to 22 carbon atoms or a benzyl group, $R_2$ is an alkyl group of 1 to 22 carbon atoms or a $(C_mH_{2m}O)_nH$ group (wherein m is an integer of 2 to 6, and n is an integer of 1 to 50), $R_3$ and $R_4$ are each independently an alkyl group of 4 to 22 carbon atoms or a $(C_mH_{2m}O)_nH$ group (wherein m is an integer of 2 to 6, and n is an integer of 1 to 50).

6. The waterproof sheet according to claim 5 wherein $R_1$ in the general formula is a methyl group, and $R_2$, $R_3$ and $R_4$ are each an alkyl group of 1 to 18 carbon atoms.

7. The waterproof sheet according to claim 1, 2, 3, 4, 5 or 6 wherein layers of highly aggregated fine pores each having a pore size of 0.1 to 1.0 μm are formed near the boundary face between the fabric and the wet coagulated polyurethane film.

8. The waterproof sheet according to claim 1, 2, 3, 4, 5, 6 or 7 wherein fine pores open to the surface of the wet coagulated polyurethane film each have a pore size of 0.05 to 2 μm.

9. A process for preparing a highly water-pressure-resistant and highly moisture-permeable waterproof sheet comprising dissolving a polyurethane into a solvent containing mainly a nitrogen-containing polar solvent, dispersing from 0.5 to 20% by weight, based on the solid component of the polyurethane, of a organophilic clay complex prepared by introducing a quaternary ammonium ion into the interlayers of a expandable phillosilicate, coating a fabric with the resultant solution, immersing the coated fabric in a coagulation bath whereby the polyurethane is coagulated, washing the resultant coated fabric, and drying it.

10. The method according to claim 9 wherein said nitrogen-containing polar solvent is dimethyl-formamide.

11. The method according to claim 9 wherein said expandable phillosilicate is at least one substance selected from the group consisting of smectite clay and swelling mica.

12. The method according to claim 11 wherein said expandable phillosilicate is smectite clay.

13. The method according to claim 9 wherein said organophilic clay complex is in flaky fine particles each having a thickness of 0.001 to 0.04 μm.

* * * * *